US005781168A

United States Patent [19]

Osada et al.

[11] Patent Number: 5,781,168

[45] Date of Patent: Jul. 14, 1998

[54] APPARATUS AND METHOD FOR DRIVING AN ELECTROLUMINESCENT DEVICE

[75] Inventors: Masahiko Osada, Hekinan; Muneaki Matsumoto, Okazaki; Minoru Yokota, Nagoya, all of Japan

[73] Assignee: Nippondenso Co., Ltd., Kariya, Japan

[21] Appl. No.: 802,010

[22] Filed: Feb. 18, 1997

Related U.S. Application Data

[63] Continuation of Ser. No. 341,902, Nov. 15, 1994, abandoned.

[30] Foreign Application Priority Data

Nov. 15, 1993 [JP] Japan ..... 5-309921

[51] Int. Cl.[6] ..... G09G 3/30

[52] U.S. Cl. ..... 345/76; 345/94

[58] Field of Search ..... 345/76–80, 94; 315/169.3

[56] References Cited

U.S. PATENT DOCUMENTS

| | | | |
|---|---|---|---|
| 3,629,653 | 12/1971 | Irwin | 345/78 X |
| 4,044,345 | 8/1977 | Ueda et al. | 345/78 |
| 4,366,504 | 12/1982 | Kanatani | 348/800 |
| 4,649,383 | 3/1987 | Takeda et al. | 345/94 |
| 4,724,433 | 2/1988 | Inoue et al. | 345/87 |
| 4,733,228 | 3/1988 | Flegal | 345/76 |
| 4,830,466 | 5/1989 | Matsuhashi et al. | 345/103 |
| 4,893,060 | 1/1990 | Ohba et al. | 345/79 |
| 5,066,893 | 11/1991 | Osada et al. | 345/45 |

*Primary Examiner*—Amare Mengistu

*Attorney, Agent, or Firm*—Cushman Darby & Cushman IP Group of Pillsbury Madison & Sutro LLP

[57] ABSTRACT

Method of driving a matrix-addressed electroluminescent device without deteriorating it. A display data driving voltage is applied to the column electrodes. A line scanning driving voltage is applied to the row electrodes successively. Before the display data driving voltage ceases, the line scanning driving voltage applied to the row electrode acting as a common electrode for all electroluminescent cells in one column is turned off. Thus, these cells are deactivated almost simultaneously. Electric charges remaining on the electro-luminescent cells in this row do not induce spike voltages on other electroluminescent cells. Therefore, deterioration of the electroluminescent cells is prevented. Electric charges produced when the row electrode-driving voltage is turned off flow directly into a power supply for the row electrodes. This power supply is designed to absorb the flowing charges. The potential is prevented from exceeding the power voltage. This protects the row electrode-driving power supply against destruction.

11 Claims, 7 Drawing Sheets

FIG. IA WAVEFORM 611

FIG. IB WAVEFORM 211

FIG. IC WAVEFORM 212

FIG. ID WAVEFORM 210+N

FIG. IE WAVEFORM 612

APPARATUS AND METHOD FOR DRIVING AN ELECTROLUMINESCENT DEVICE

This is a continuation of application No. 08/341,902, filed on Nov. 15, 1994, which is now abandoned.

CROSS REFERENCE TO RELATED APPLICATION

This application claims the benefit of priority of the prior Japanese patent application No. 5–309921 filed on Nov. 15, 1993, the contents of which are incorporated herein by reference.

BACKGROUND OF THE INVENTION

1. Field of the Invention

The present invention relates to an apparatus and method for driving an electroluminescent device and, more particularly, to an apparatus and method for energizing a dot-matrix electro-luminescent device.

2. Description of the Related Arts

A conventional dot-matrix electroluminescent device is shown in FIG. 2, where a luminescent layer 40 is sandwiched between row electrodes 60 and column electrodes 20. Each of these electrodes takes the form of a stripe. The row electrodes 60 and column electrodes 20 are arranged so as to intersect each other at right angles. To display a visible image, it is common practice to linearly successively scan the electrodes of one of these two kinds of mutually intersecting electrodes, e.g., the row electrodes, while a display data drive voltage is applied to the other kind of electrodes, i.e., the column electrodes 20, for controlling lighting at each intersection. This display data drive voltage is controlled by pulse width modulation. In this way, those portions of the luminescent layer 40 which are located at the intersections of the row and column electrodes are lit up. In the description given below, it is assumed that the row electrodes are linearly successively scanned.

FIG. 4 is an equivalent circuit of the electroluminescent device shown in FIG. 2 and a circuit for driving it. In this system, a line scanning drive voltage $-V_{th}$ is applied to the row electrodes 60 successively. At the same time, a given column drive voltage $V_w$ according to data to be displayed with the column electrodes is applied to light up electroluminescent cells in each column position of this row. After cessation of the column drive voltage $V_w$, the row drive voltage $-V_{th}$ for one row is turned off. The next row is selected and the row drive voltage $-V_{th}$ is applied to perform a similar lighting operation. These scans and lighting operations are repeated for all the rows. This is referred to as a scan for one field or for one frame. Then, a row drive voltage +Vth is applied. Also, a reverse column drive voltage, i.e., $-V_w$, is applied to impress a reverse bias. In this way, the lighting is controlled. One complete AC drive operation is carried out every two frames. Whenever electroluminescent cells are lit up, a voltage difference $(V_{th}+V_w)$ is applied. In this way, the electro-luminescent device is made to emit light. This activation method is known as the field inversion driving method or the pn symmetrical driving method. Also, the field refresh driving method has been put into practical use. In particular, whenever a scan of one frame is complete, a refresh pulse of reverse voltage is applied. This method is similar in principle to the aforementioned techniques. This known circuit is fabricated as an integrated circuit and has been put into the market as an IC for driving an electroluminescent device.

However, when an electroluminescent device is activated, signals of the column drive voltage $V_w$ usually applied to each column electrode 20 are not always simultaneously turned off because of variations in switching circuit characteristics and variations in electroluminescent device characteristics. Especially, where the gray level is controlled by pulse width modulation, adjacent electroluminescent cells generally produce different levels of brightness. Therefore, it can be said that pulses cease at totally random times. At this time, of the electroluminescent cells in each column position connected in parallel with the row electrodes 60, electric charges stored in the capacitive components of the emitting electroluminescent cells flow through the row electrodes 60 and the potentials approach their original potentials. As a result, the charges flow into the capacitive components of the other electroluminescent cells which are not yet deactivated.

In the worst case, driving signal timing as illustrated in FIGS. 8A–8E may be contemplated. That is, FIG. 3 is an equivalent circuit of a row electrode 601 and column electrodes connected with the row electrode 601. The above-described phenomenon is now described, using this circuit diagram. Electroluminescent cells 701, 702, ..., 700+N are connected with column electrodes 201, 202, etc. It is now assumed that the electroluminescent cell 701 is deactivated later than the other electroluminescent cells 702, 703, ..., 700+N. Electric charges in the electroluminescent cells 702, 703, ..., 700+N, which have contributed to emission of light at other cells, flow through line resistances $R_i$ (i=2, 3, ..., N) of the row electrode and try to lower the potential. However, ITO films often used as the row electrodes 60 have larger specific resistances than metal electrodes. Also, the row driving power supply has an impedance $R_o$ (not shown). Because of the presence of these resistances and impedance, it is impossible to lower the potential on each electroluminescent cell by rapidly releasing electric charge stored in each electroluminescent cell. As a result, the electric charges flow into the electroluminescent cell 701 which is not yet deactivated, as shown by an arrow indicated by broken lines in FIG. 3. This is known as surge. As a result, a spike voltage is induced in the capacitive component of the electroluminescent cell 701, thus lowering the substantial voltage applied to the cell 701. This is applied as a voltage to activated electroluminescent cells which are equal in number to electroluminescent cells deactivated earlier. Since electroluminescent cells are, in principle, driven with a voltage of 200 V which is relatively large for an electronic circuit, the spike voltage induced by surge is considerably large. As a result, the voltage applied to each individual electroluminescent cell is an overload. This promotes deterioration of this cell. Finally, a dot formed by this cell is destroyed, i.e., the cell cannot be deactivated or keeps emitting. Hence, the life of the electroluminescent device is shortened.

A group including the present inventors has already proposed an apparatus for preventing such spike voltages in a segment-type electroluminescent device by controlling the timing at which signals are applied, as described in U.S. Pat. No. 5,066,893. In this method, all electroluminescent cells are deactivated at the same timing to prevent application of an overvoltage to any one electroluminescent cell. To achieve this timing, applied activating voltages are canceled out by deactivating voltages within a certain period of time.

In this apparatus described in the above-cited U.S. Pat. No. 5,066,893, each segment is equipped with a voltage supply means for applying the deactivating voltages. Where the number of the segments is relatively small, such as in a 7-segment device, serious problems do not occur. In the case of an electroluminescent device made up of a quite large number of cells, the circuit configuration is made very complex. In addition, electric power consumed increases.

SUMMARY OF THE INVENTION

It is an object of the present invention to provide a method of driving a matrix-addressed electroluminescent device in such a way that the electric power consumed does not increase and that each individual electroluminescent cell is not readily deteriorated.

An apparatus for driving an electroluminescent device according to the invention comprises a luminescent layer sandwiched between a set of first electrodes and a set of second electrodes which are arranged in rows and columns. The intersections of the first electrodes and second electrodes form electroluminescent cells. A line scanning drive voltage is applied to the first electrodes successively. A display data drive voltage is applied to the second electrodes. When these two voltages exceed their threshold voltages, the corresponding electroluminescent cell is activated.

In a first feature of the invention, any one of the first electrodes is selected. The line scanning driving voltage is applied to this selected cell. During this application of the voltage, the display data driving voltage is applied to plural second electrodes. In this way, the electroluminescent cell or cells sandwiched between the selected first electrodes and the plural second electrodes are activated. For deactivation, the line scanning driving voltage applied to the selected first electrode is switched to a value less than the threshold voltage necessary to deactivate the emitting cell while maintaining the display data driving voltage applied to the second electrodes.

In this case, the first electrode acts as a common electrode for the plural second electrodes. Therefore, electroluminescent cells associated with this first electrode are simultaneously deactivated by lowering the line scanning driving voltage applied to the first electrode. As a result, during a deactivating operation, electric charges stored in the electroluminescent cells do not flow into electroluminescent cells not yet deactivated. Hence, application of a spike voltage to the electroluminescent cells is prevented. In this first feature, plural electroluminescent cells are simultaneously deactivated by lowering the line scanning driving voltage applied to the common electrode and so the electric power consumed is not increased.

In a second feature of the invention, any one of plural first electrodes is selected. A line scanning driving voltage is applied to the selected first electrode. During the application of this voltage, a display data driving voltage is applied to plural second electrodes. This enables selected electroluminescent cells to be activated. On the other hand, during a deactivating operation, the display data driving voltage applied to the second electrodes is switched to a value less than the threshold voltage necessary to deactivate the emitting cells with incremental delays for the electrodes while maintaining the line driving voltage applied to the first electrode.

In this case, spike voltages are induced when the applied voltage is switched to less than the threshold voltage. However, because the electrodes are deactivated not simultaneously but successively, the generated spike voltages are small. Because each spike voltage is absorbed by all emitting electroluminescent cells, the voltage applied to each cell is not an overload. Consequently, deterioration of the matrix-addressed electroluminescent cells is not promoted. In the second feature, electroluminescent cells are simultaneously deactivated by reducing the display data driving voltage impressed on the second electrodes. As a result, the electric power consumed is prevented from increasing.

DESCRIPTION OF THE PREFERRED EMBODIMENTS

(First Embodiment)

The preferred embodiments of the invention are hereinafter described in detail.

Figure 1:
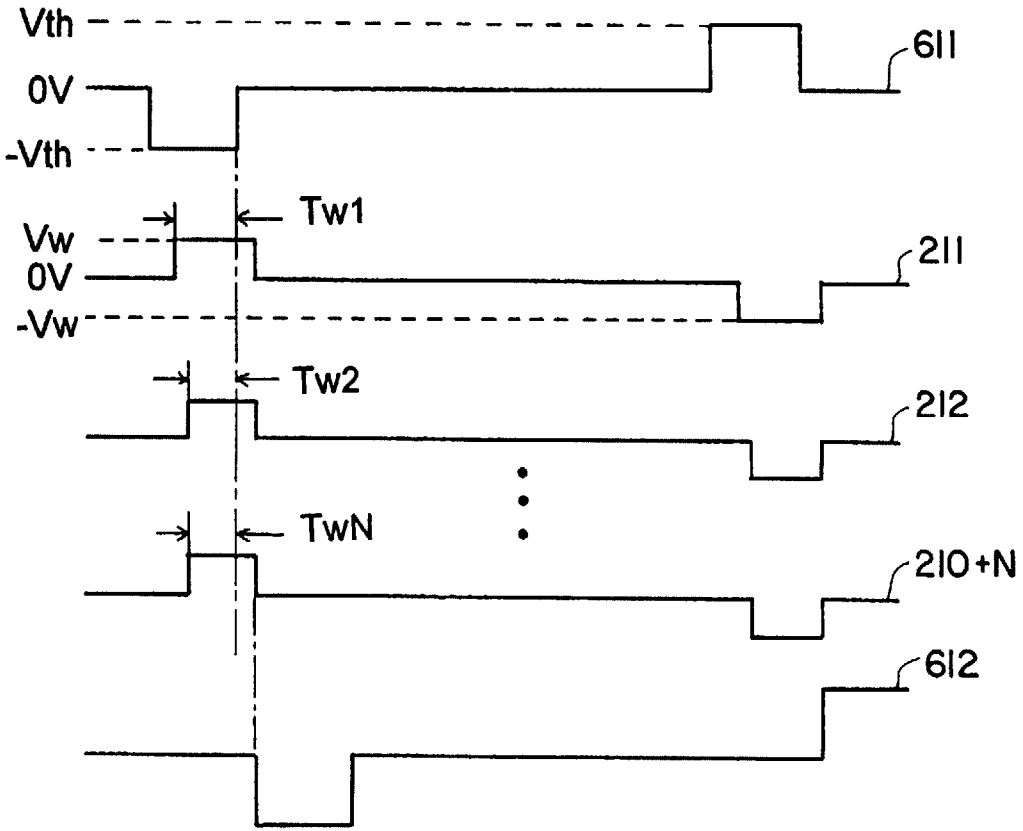
FIGS. 1A–1E are waveforms illustrating timing at which driving voltages are applied to row electrodes and column electrodes in an electroluminescent device according to the invention.
Figure 2:
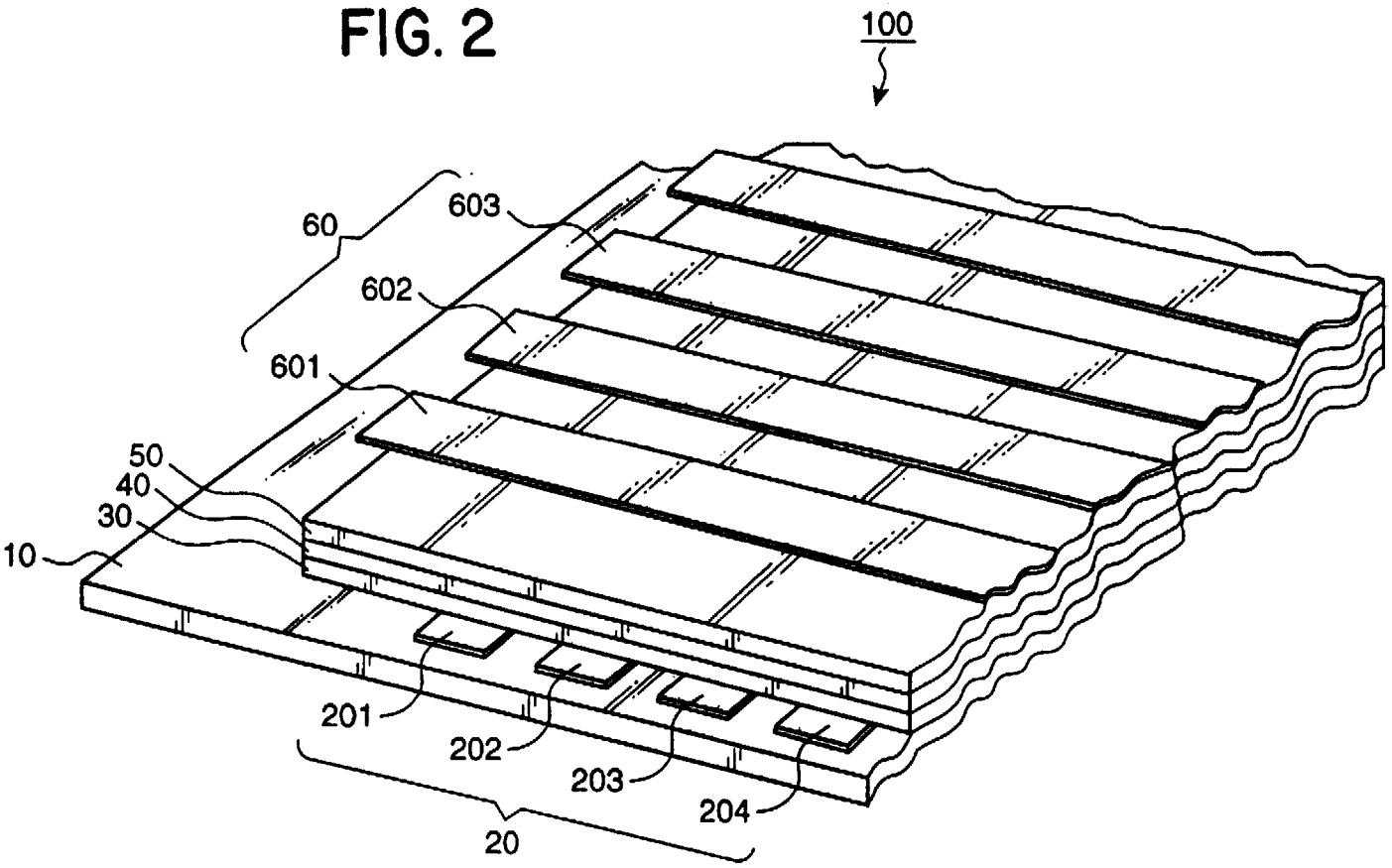
FIG. 2 is a fragmentary perspective view of a matrix-addressed electroluminescent device according to the present invention.
Figure 3:
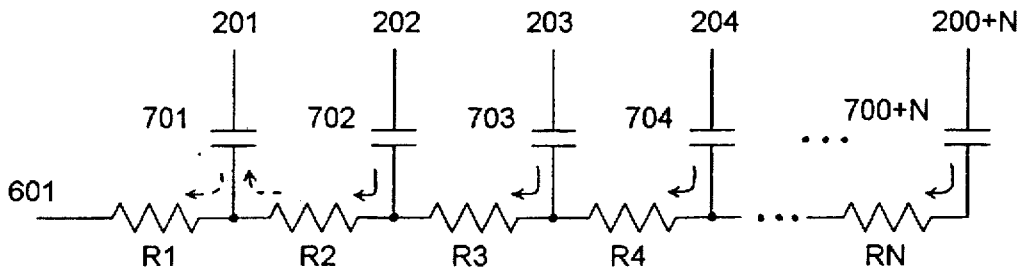
FIG. 3 is an equivalent circuit diagram of one row of a matrix-addressed electroluminescent device.

FIG. 1 is a waveform chart illustrating timings at which driving voltages are applied to their respective electrodes in an electroluminescent device activated by a method according to the present invention. This timing prevents the generation of spike voltages and deterioration of the electroluminescent device. The activated electroluminescent device is constructed as shown in FIG. 2 and is of the known dot-matrix structure. In this example, a line scanning driving voltage is applied to row electrodes successively. A display data driving voltage is applied to column electrodes. Therefore, the above-described first electrodes are row electrodes (i.e., electrodes arrayed horizontally), while the above-described second electrodes are column electrodes (i.e., electrodes arrayed vertically) in the description given below. When a scan of all rows ends, a scan of one frame is finished.

Figure 6:
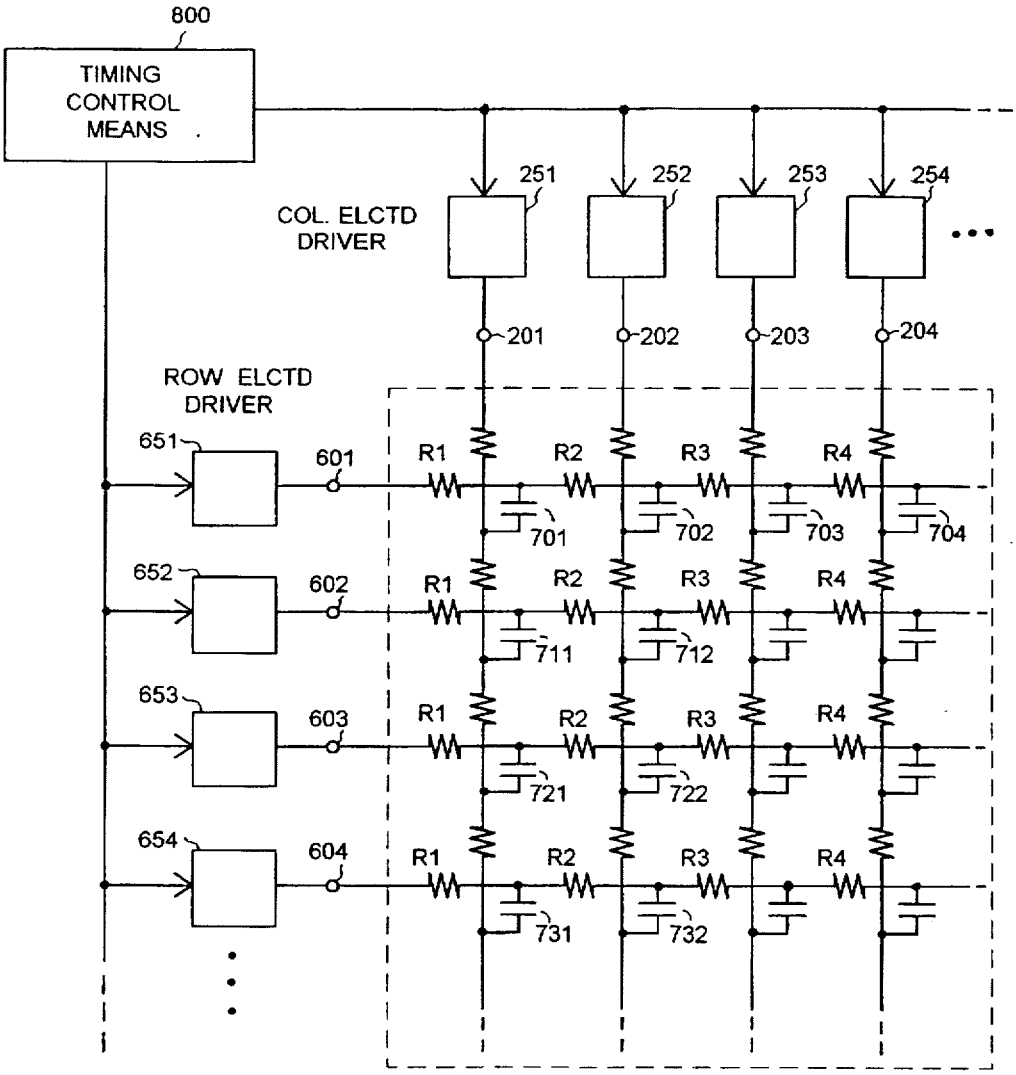
FIG. 6 is an equivalent circuit diagram of the electroluminescent device shown in FIG. 2.

A matrix-addressed electroluminescent device of the known structure is shown in FIG. 2. Column electrodes 20 are arrayed on a glass substrate 10. The column electrodes 20 consist of a film of ITO (indium-tin oxide) and each assumes the form of a stripe. Row electrodes 60, also consisting of a film of ITO, are arrayed perpendicularly to the column electrodes 20. Each row electrode 60 takes the form of a stripe. A luminescent layer 40 made from zinc sulfide: manganese (ZnS:Mn) and dielectric layers 30 and 50 formed on opposite surfaces of the luminescent layer 40 are sandwiched between the array of the column electrodes 20 and the array of the row electrodes 60. Cells formed in the luminescent layer at the intersections of the row electrodes and the column electrodes act as electrical capacitors, and each cell forms a pixel in the dot-matrix electroluminescent device. As a whole, a matrix-addressed electroluminescent device is formed. As shown in FIG. 6, row electrode driving circuits 651, 652, ..., 650+M are electrically connected with to, the row electrodes. The lines are successively scanned with row driving voltage waveforms 611, 612, ..., 610+M (M is the number of the row electrodes), the waveforms excluding 610+M being shown in FIG. 1. In this way, the row electrodes 60 are selected. Column electrode driving circuits 251, 252, 250+N are connected with the column electrodes. Column driving voltage waveforms 211, 212, ..., 210+N (N is the number of the column electrodes) are applied, corresponding to the row driving voltages. In this way, a visible image is displayed on the electroluminescent device.

The row and column electrodes of this electroluminescent device shown in FIG. 2 are driven by the row electrode driving circuits and the column electrode driving circuits at the timing illustrated in FIG. 1. In this way, a visible image is created on the electroluminescent device. Any known electronic circuits producing the driving voltages shown in FIG. 1 can be used as the row electrode driving circuits and the column electrode driving circuits. The waveforms shown in FIG. 1 are row electrode driving voltage waveform 611 for the first row, column electrode driving voltage waveforms 211, 212, ..., 210+N for the column electrodes corresponding to the waveform 611, and row electrode driving voltage waveform 612 for the second row. Column electrode driving voltage waveforms corresponding to the waveform 612 and waveforms for the following rows are omitted. After all the rows are scanned, the row electrode driving voltage waveform 611 for the first row is again selected. At this time, the polarity of the applied voltage is reversed. The driving timing shown in FIG. 1 is described in further detail below.

When one row 601 is selected, −Vth is applied as the line scanning driving voltage. Under this condition, the column electrode driving voltage circuits apply the display data driving voltages $+V_w$ to their respective column electrodes 201–200+N of the electroluminescent cells of the specified columns. A voltage $(V_w+V_{th})$ is applied to the desired electroluminescent cells of this row, so that the desired cells are activated. In this way, the electroluminescent cells of this row 601 emit light, thus contributing to creation of a visible image. The driving voltage $V_w$ varies the pulse widths $Tw_i$(i=1, 2, ..., N) of the pulses applied to the column electrodes according to the display data to create various gray levels. Where the application of the driving voltage $V_w$ to the column electrodes 201–200+N is ended, the starting point of the application of the column electrode driving voltages is controlled so that the application of the driving voltage $V_w$, persists until the row electrode driving voltage waveform 611 ceases as shown in FIG. 1. That is, each electroluminescent cell is activated when the driving voltage $V_w$ is applied to the column electrodes after the row electrode driving voltage $-V_{th}$ is prepared. Each cell is deactivated when the row electrode driving voltage $-V_{th}$ ceases. At this time, the voltage is turned off by the common electrode, or the row electrodes, and so all the electroluminescent cells of this row are simultaneously deactivated. It is unlikely that electric charge-flows into one or some cells from other cells. That is, surge does not take place.

Figure 4:
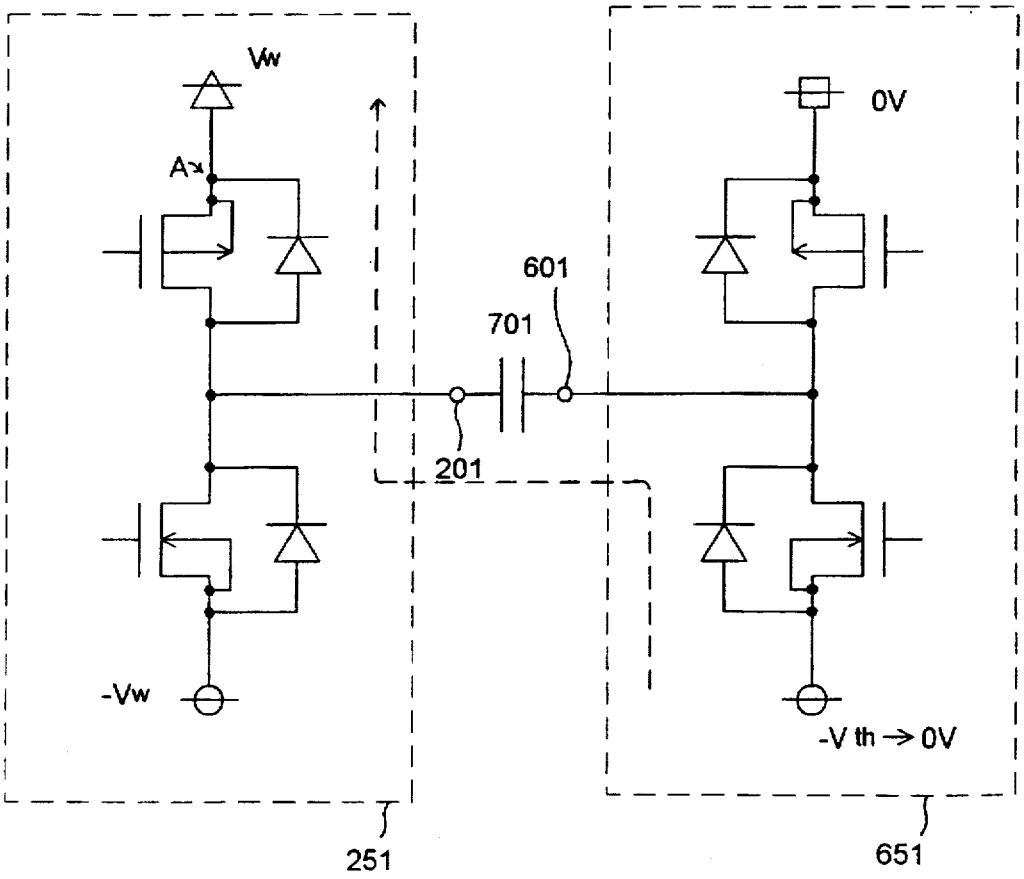
FIG. 4 is a circuit diagram illustrating a surge voltage induced when a row electrode driving voltage is turned off during activation of an electroluminescent device.
Figure 5:
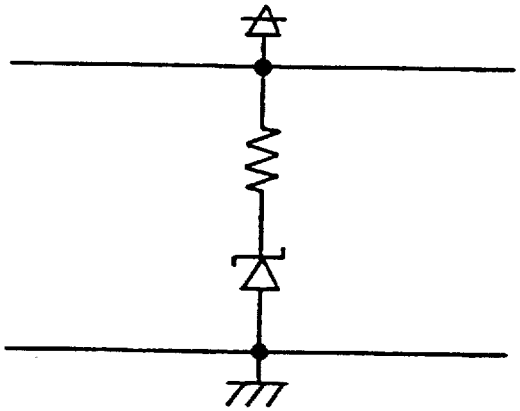
FIG. 5 is a circuit diagram of one example of current-absorbing mechanism in a row electrode driving voltage circuit.

In this case, when the row electrode is deactivated, all the electric charges remaining on the electroluminescent cells are directed toward the column electrode driving power supply circuit which is still ON. Therefore, as shown in FIG. 4, a high voltage is produced in a portion A that is the power supply circuit for the column electrode driving circuits. With the prior art circuit configuration, there is the possibility that the power supply circuit is deteriorated or destroyed by an overvoltage. In the present invention, however, this power supply circuit delivers and absorbs electrical current. Consequently, the surge voltage induced in the portion A in FIG. 4 is absorbed, whereby the voltage is regulated. Accordingly, neither the electroluminescent cells nor the column electrode driving circuits present problems. FIG. 5 shows an example in which a regulated-voltage source $V_w$ is equipped with a zener diode to absorb an overvoltage. In this structure, the overvoltage generated in the portion A of FIG. 4 is absorbed. Of course, any circuit configuration yields similar advantages as long as the power supply is designed to deliver and absorb electric current. It is to be noted that the driving circuits shown in FIG. 4 are only parts of the structure.

The present invention exploits this circuit configuration as well as the driving timing described above. Comparison with the conventional driving timing shown in FIGS. 8A–8E shows that the present invention yields conspicuous effects. Table 1 below shows results of comparisons made under the following conditions:

driving frequency: 916 Hz pulse widths: 15 μs (for waveforms falling quickly) 32 μus (for waveforms falling slowly)

column electrode driving voltage $V_w$: 70 V number of the column electrodes N: 21 number of the row electrodes M: 20 row electrode driving voltage $V_{th}$: 230 V Electroluminescent devices used for the comparisons are rated in such a way that they are usually used below 180 V ($V_{th}$<180 V). They were driven with overvoltages. That is, accelerated deterioration tests were performed. As a result, with respect to destruction rate of pixels, or dots, a difference was observed at a level of significance of 25%. The novel structure resulted in a lower destruction rate. Especially, when column electrode voltage waveforms rising slowly were applied, the destruction rate of the pixels showed a difference at a level of significance of 0.5%. This demonstrates the effectiveness of the present invention.

TABLE 1

| | Number of tested pixels | Number of destroyed pixels | Number of pixels destroyed when column electrode voltage falling slowly is applied |
|---|---|---|---|
| timing of FIG. 1 | 576 | 2 | — |
| timing of FIG. 8 | 1008 | 8 | 3 |

(Second Embodiment)

Figures 7A, 7B, 7C, 7D:
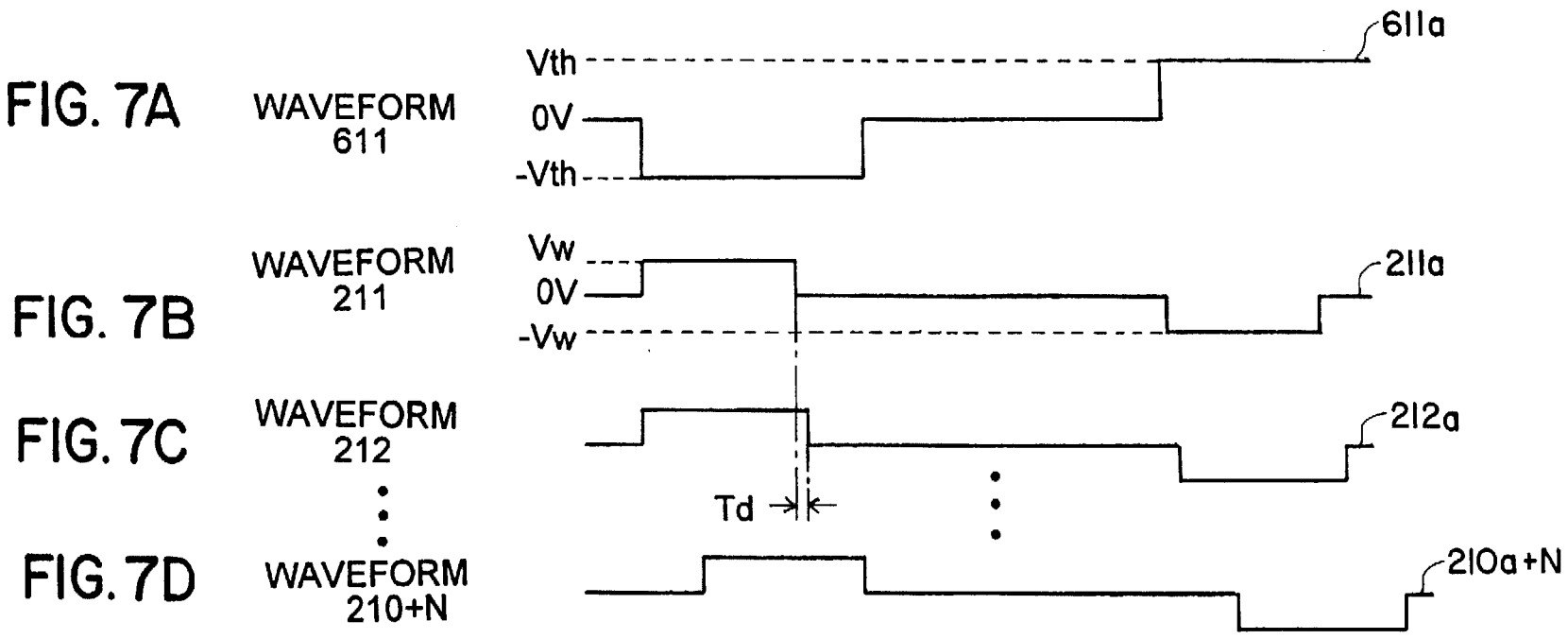
FIG. 7A–7D are waveforms illustrating timing at which driving voltages are applied to row electrodes and column electrodes in another electroluminescent device according to the invention.
Figures 8A, 8B, 8C, 8D, 8E:
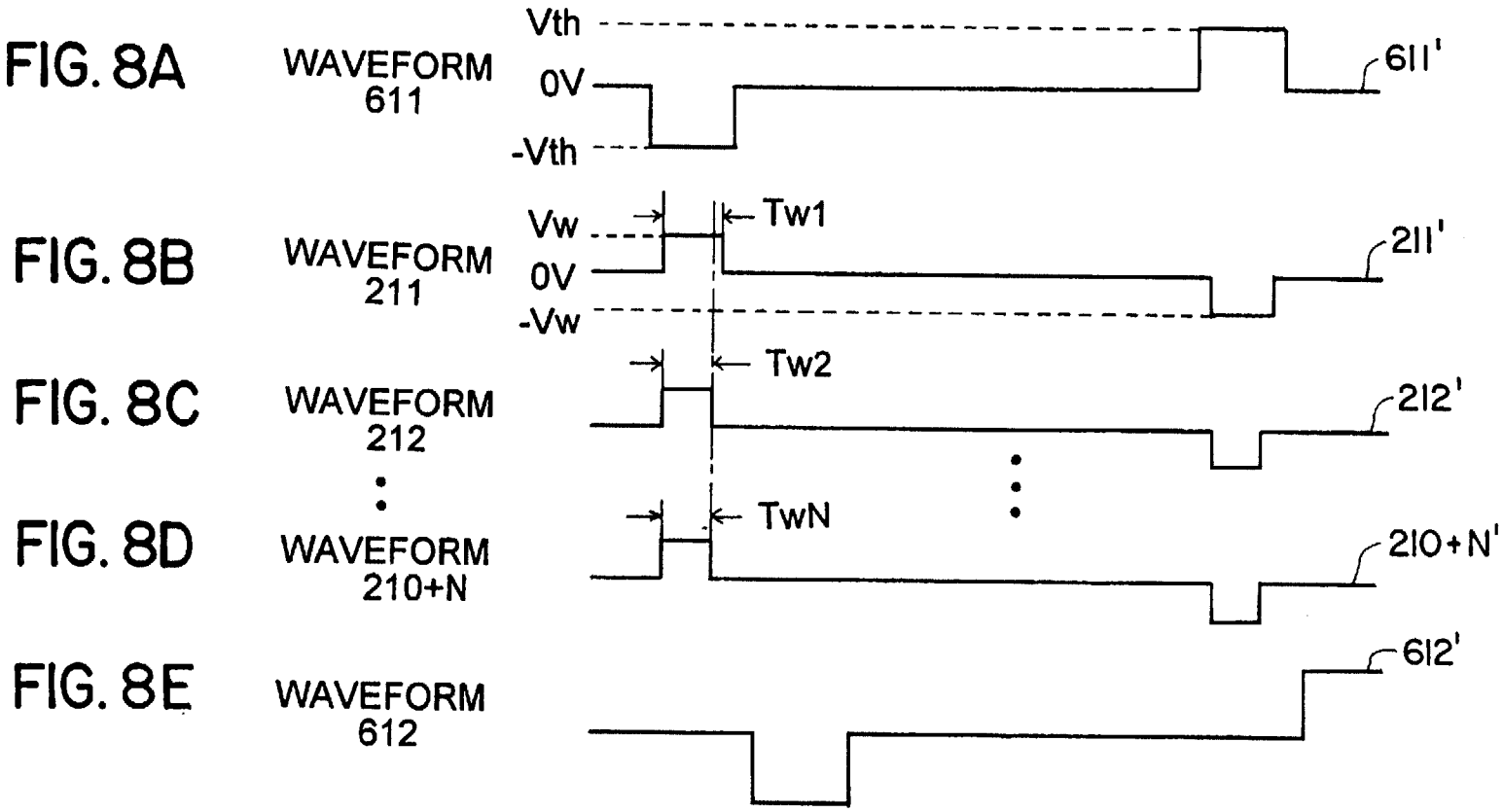
FIG. 8A–8E are waveforms illustrating timings at which driving voltages are applied to row electrodes and column electrodes in an electroluminescent device of the conventional construction.

FIG. 7 is a timing chart illustrating the driving timing of a second embodiment of the invention. Before the row electrode driving voltage waveform 611*a* applied to the common electrode ceases, the applications of various column electrode driving voltage waveforms are ended successively, i.e., with a progressively increased delay corresponding to successive dots. Thus, generation of a spike voltage due to surge is prevented. The trailing edges of the column electrode driving voltages are progressively delayed with a delay time Td. Therefore, only electric charge remaining on the individual cells of the dot-matrix electroluminescent device contained in one row is released. Hence, a large spike voltage is not produced. In consequence, it is unlikely that any electroluminescent cell is overloaded.

It may be possible to delay with a delay time Td for a plurality of the column electrodes.

In this way, the present invention permits a dot-matrix electroluminescent device to be driven without deteriorating it. Consequently, the durability of the electroluminescent device can be enhanced.

What is claimed is:

1. A method of driving an electroluminescent device including electroluminescent cells arranged in rows and columns, said electroluminescent cells comprising a luminescent layer for emitting light, an array of first electrodes, and an array of second electrodes, said arrays of said first and second electrodes being disposed on opposite sides of said luminescent layer and arranged so as to intersect one another, said method comprising the steps of:

applying a line scanning driving voltage to a first electrode in said first array of electrodes;

applying display data driving voltages to a plurality of second electrodes in said array of second electrodes to activate said electroluminescent cells defined at an intersection of said first electrode and said plurality of second electrodes, said display data driving voltages being smaller than said scanning driving voltage; and controlling said line scanning driving voltage and said display data driving voltages such that said line scanning driving voltage applied to said first electrode switches to a value less than a threshold value to release electrons charged in a plurality of activated electroluminescent cells arranged in a row simultaneously to deactivate the activated electroluminescent cell arranged in a row before said display data driving voltages applied to said plurality of second electrodes is lowered.

2. A method of driving an electroluminescent device as set forth in claims , wherein said display data driving voltages applied to said plurality of second electrodes are switched off simultaneously with said switching of said line scanning driving voltage to said value less than said threshold.

3. A method of driving an electroluminescent device as set forth in claim 1, further comprising a step of applying said line scanning driving voltage to a successive electrode in said array of first electrodes after ceasing to apply said line scanning driving voltage to said first electrode, and wherein a time period exists between applying said line scanning driving voltage to said successive electrode and ceasing to apply said line scanning driving voltage to said first electrode.

4. A method of driving an electroluminescent device as set forth in claim 1, wherein an OFF timing of said display data driving voltages applied to said plurality of second electrodes are substantially the same, pulse widths of said display data driving voltages applied to said plurality of second electrodes being varied by providing different ON timings for said display data driving voltages applied to said plurality of second electrodes.

5. An apparatus for driving an electroluminescent device including electroluminescent cells comprising a luminescent layer for emitting light, an array of first ITO electrodes, and an array of second ITO electrodes, said arrays for said first and second ITO electrodes being disposed on opposite sides of said luminescent layer and arranged to intersect each other, said apparatus comprising:

first voltage application means for applying a line scanning driving voltage to a first ITO electrode in said array of first ITO electrodes;

second voltage application means for applying display data driving voltages to a plurality of second ITO electrodes in said array of second ITO electrodes, said display data driving voltages being smaller than said scanning driving voltage, said plurality of second ITO electrodes intersecting said first ITO electrode; and timing control means for controlling a timing at which said first voltage application means applies said line scanning driving voltage to said first ITO electrode and a timing at which said second voltage application means applies said data display voltage driving voltage to said plurality of second ITO electrodes, said timing control means causing said first and said second voltage application means to apply said display data driving voltages to said plurality of second ITO electrodes during application of said line scanning driving voltage to said first ITO electrode, thereby activating electroluminescent cells sandwiched between said first ITO electrode and said plurality of second ITO electrodes;

wherein said timing control means switches said line scanning driving voltage applied to said first ITO electrode to a value less than a threshold value to release electrons charged in a plurality of activated electroluminescent cells arranged in a row simultaneously to deactivate the activated electroluminescent cell arranged in a row during application of said display data driving voltages to said plurality of second ITO electrodes, thus deactivating electroluminescent cells sandwiched between said first ITO electrode and said plurality of second ITO electrodes.

6. The apparatus of claim 5, wherein said timing control means is further for causing said first voltage application means to provide said line scanning driving voltage successively to said ITO electrodes in said array of first ITO electrodes, one at a time, from a beginning ITO electrode located at one end of said array of said first ITO electrodes and to again successively apply said line scanning driving voltage to said array of first ITO electrodes from said beginning ITO electrode after said line scanning driving voltage has been applied to all ITO electrodes in said array of first ITO electrodes.

7. The apparatus of claim 5, wherein said timing control means is for switching said line scanning drive voltage applied to said first ITO electrode to a value less than said threshold value by inhibiting said first voltage application means from applying said line scanning driving voltage to said first ITO electrode.

8. The apparatus of claim 5, wherein said first voltage application means includes a regulated voltage source for delivering and absorbing electric current.

9. The apparatus of claim 5, wherein said timing control means further is for controlling said line scanning driving voltage and said display data driving voltages such that said display data driving voltages applied to said plurality of second ITO electrodes are switched off simultaneously with said switching of said line scanning driving voltage to said value less than said threshold.

10. The apparatus of claim 5, wherein said timing control means further is for controlling said line scanning driving voltage such that said line scanning driving voltage is applied to a successive ITO electrode in said array of first ITO electrodes after said line scanning driving voltage ceases to be applied to said first ITO electrode, and wherein a time period exists between applying said line scanning driving voltage to said successive ITO electrode and ceasing to apply said line scanning driving voltage to said first ITO electrode.

11. The apparatus of claim 5, wherein said timing control means further is for controlling said line scanning driving voltage and said display data driving voltages such that an OFF timing of said display data driving voltages applied to said plurality of second ITO electrodes are substantially the same, pulse widths of said display data driving voltages applied to said plurality of second ITO electrodes being varied by providing different ON timings for said display data driving voltages applied to said plurality of second ITO electrodes.

* * * * *